US006672805B1

(12) United States Patent
White

(10) Patent No.: US 6,672,805 B1
(45) Date of Patent: Jan. 6, 2004

(54) SYSTEMS AND METHODS FOR DRIVING LARGE DIAMETER CAISSONS

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 10/260,116

(22) Filed: Sep. 27, 2002

Related U.S. Application Data

(60) Provisional application No. 60/325,881, filed on Sep. 27, 2001.

(51) Int. Cl.[7] ..... E02D 7/00; E02D 7/18; E21B 7/24

(52) U.S. Cl. ..... 405/232; 405/231; 405/249; 175/56; 175/135; 173/42; 173/44; 173/49

(58) Field of Search ..... 405/231, 232, 405/256, 257, 249; 175/56, 135, 171; 254/95, 97; 173/39, 42, 49, 40, 44, 162.1

(56) References Cited

U.S. PATENT DOCUMENTS

| | | | | |
|---|---|---|---|---|
| 3,686,877 A | * | 8/1972 | Bodin | 405/249 |
| 5,117,925 A | | 6/1992 | White | |
| 5,263,544 A | | 11/1993 | White | |
| 5,355,964 A | | 10/1994 | White | |
| 5,544,979 A | | 8/1996 | White | |
| 5,549,168 A | | 8/1996 | Sadler et al. | |
| 5,609,380 A | | 3/1997 | White | |
| 5,653,556 A | | 8/1997 | White | |
| 5,794,716 A | | 8/1998 | White | |
| 6,039,508 A | | 3/2000 | White | |
| 6,386,295 B1 | * | 5/2002 | Suver | 405/232 |
| 6,427,402 B1 | | 8/2002 | White | |
| 6,431,795 B2 | | 8/2002 | White | |
| 6,447,036 B1 | | 9/2002 | White | |
| 6,582,158 B1 | * | 6/2003 | Van Stein | 405/232 |

FOREIGN PATENT DOCUMENTS

| | | | |
|---|---|---|---|
| GB | 2043755 | * 10/1980 | 405/232 |

* cited by examiner

*Primary Examiner*—Jong-Suk (James) Lee
(74) *Attorney, Agent, or Firm*—Michael R. Schacht; Schacht Law Office, Inc.

(57) ABSTRACT

A system for driving a large diameter caisson into the ground, comprising a crane assembly, a plurality of vibratory devices, a clamp assembly, a suspension assembly, and a timing system. Each vibratory device generates a vibratory force. The clamp assembly rigidly secures each of the vibratory devices to one of a plurality of predetermined angularly spaced locations about the caisson. The suspension assembly connects the vibratory devices to the crane assembly such that transmission of vibratory forces from the vibratory devices to the crane assembly is inhibited. The timing system operatively connects the plurality of vibratory devices to synchronize the vibratory forces generated thereby.

19 Claims, 2 Drawing Sheets

SYSTEMS AND METHODS FOR DRIVING LARGE DIAMETER CAISSONS

RELATED APPLICATIONS

This application claims priority of U.S. Provisional Application Ser. No. 60/325,881, which was filed on Sep. 27, 2001.

TECHNICAL FIELD

The present invention relates to systems and methods for driving elongate members into the earth and, more particularly, to systems and methods adapted to drive large diameter caissons into the earth using vibration.

BACKGROUND OF THE INVENTION

In building, road, bridge, and other construction projects, the need often exists for driving elongate members into the ground. The elongate members may be solid, as in the case of wood or concrete piles, or they may be hollow. Hollow piles are typically made of plastic or metal.

The present invention relates to a specific type of hollow metal pile referred to as a caisson. More specifically, the present invention relates to systems and methods for driving large diameter, caissons into the ground.

U.S. Pat. Nos. 6,427,402, 6,431,795, and 6,447,036 to White disclose systems and methods for driving caissons into the earth. The systems and methods disclosed in these patents typically employ one or more vibratory devices, a clamp system for clamping the vibratory device(s) to the caisson, and a suppression system for inhibiting transmission of vibratory forces to a crane, spotter, or other system for holding the vibratory device in place. The caissons to be driven by the systems disclosed by these patents are typically less than 20 feet in diameter.

In some situations, the need exists to drive caissons of even larger diameter. For example, certain construction projects require that caissons with diameters exceeding 40 feet be driven into the ground. Although known caisson driving systems could be scaled up in size to drive such large diameter caissons, simply increasing the size of the driving system increases the costs and complexity of transporting and operating the driving system. The need thus exists for systems and methods for driving large diameter caissons that may use conventional vibratory systems and methods.

SUMMARY OF THE INVENTION

These and other objects may be obtained the systems and methods of the present invention. In particular, the present invention may be embodied as a system for driving a large diameter caisson into the ground comprising a crane assembly, a plurality of vibratory devices, a clamp assembly, a suspension assembly, and a timing system. Each vibratory device generates a vibratory force. The clamp assembly rigidly secures each of the vibratory devices to one of a plurality of predetermined angularly spaced locations about the caisson. The suspension assembly connects the vibratory devices to the crane assembly such that transmission of vibratory forces from the vibratory devices to the crane assembly is inhibited. The timing system operatively connects the plurality of vibratory devices to synchronize the vibratory forces generated thereby.

DETAILED DESCRIPTION OF THE INVENTION

Figure 1:
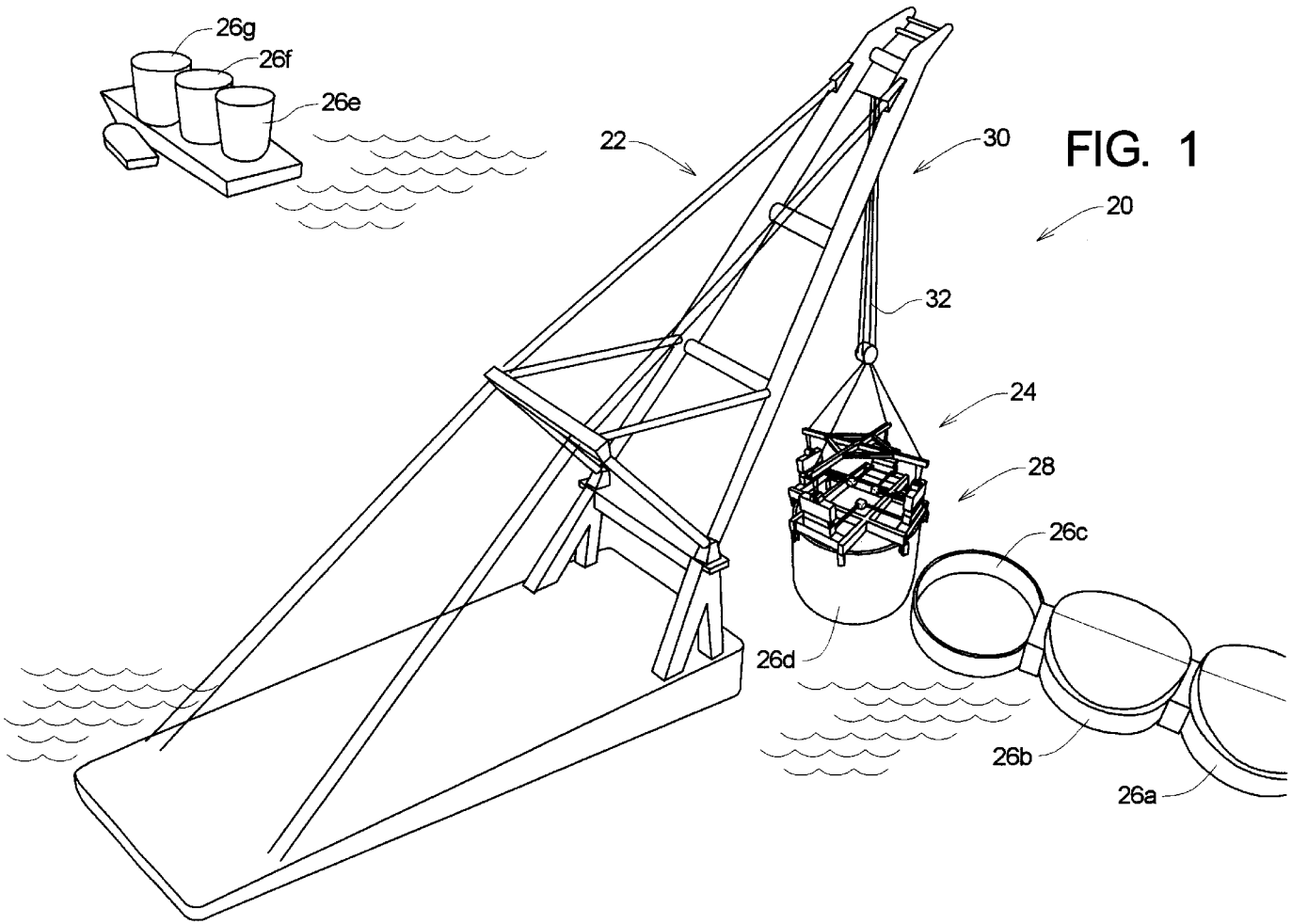
FIG. 1 is a perspective view depicting a caisson driving system of the present invention.

Referring now to FIG. 1, depicted at 20 therein is a caisson driving system 20 constructed in accordance with, and embodying, the principles of the present invention. The exemplary caisson driving system 20 comprises a crane assembly 22 and a vibratory assembly 24 and is adapted to drive caissons 26 one at a time at a desired location 28.

The crane assembly 22 is or may be conventional and comprises a rigid support structure 30 from which is suspended a crane line 32. The vibratory assembly 24 is suspended from the crane line 32 above the desired location 28.

The exemplary crane assembly 22 is barge mounted and thus adapted to drive the caissons 26 at a desired location under or near water; however, other crane assemblies may be used to implement the present invention. For example, the crane may be platform or track mounted for support and/or movement on land, and a plurality of smaller cranes may be used in place of one large crane.

Figure 2:
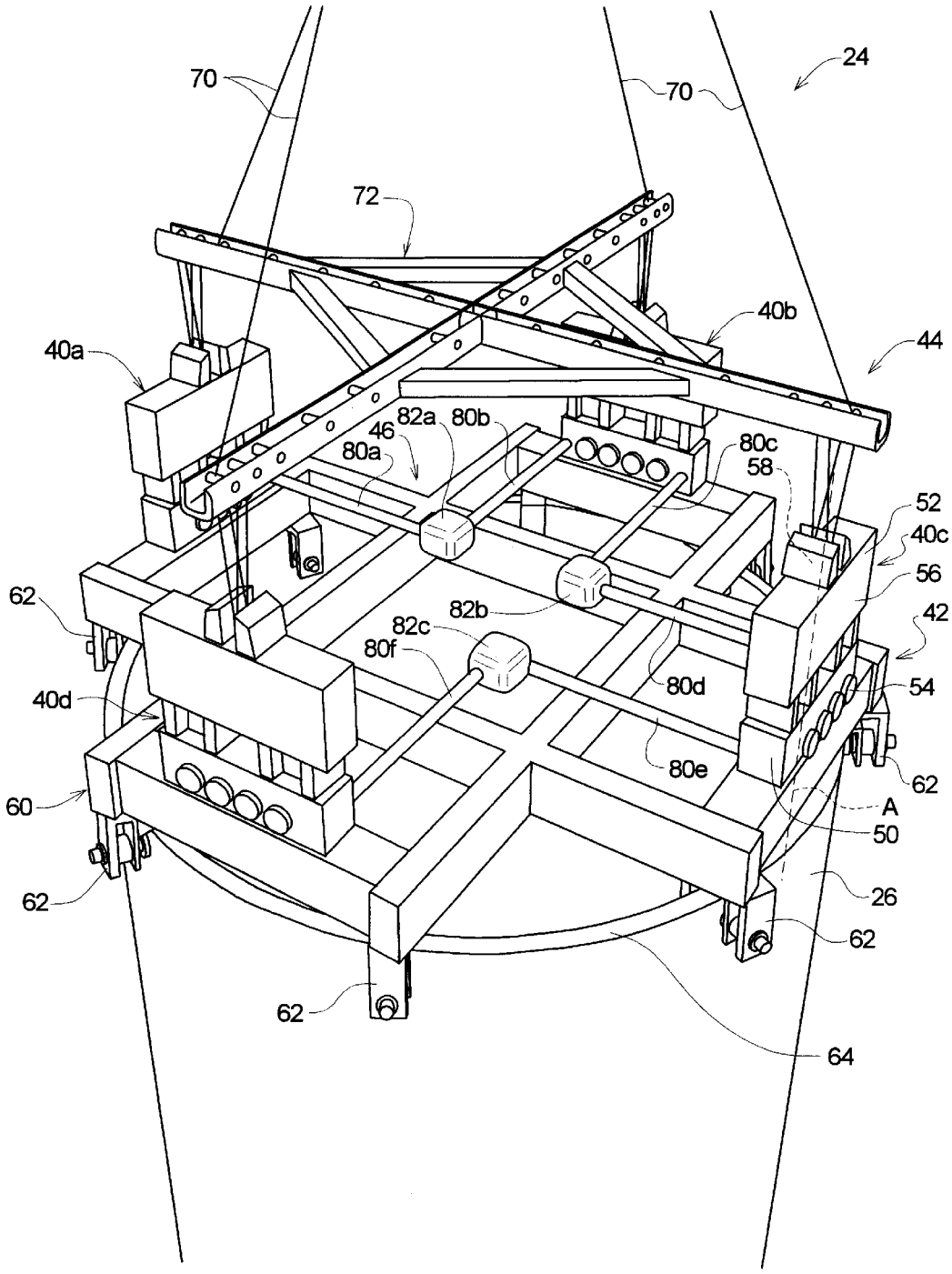
FIG. 2 is a perspective view depicting a vibratory system employed by the caisson driving system of FIG. 1.

Referring now to FIG. 2, the vibratory assembly 24 will now be described in further detail. The vibratory assembly 24 comprises a plurality of vibratory devices 40, a clamp assembly 42, a suspension assembly 44, and a timing system 46.

The vibratory devices 40 comprise a vibration unit 50 and a suppression unit 52. The vibratory devices 40 are connected between the clamp assembly 42 and the suspension assembly 44 such that vibratory forces are transmitted along a vibratory axis A to the clamp assembly 42 but not to the suspension assembly 44. In the exemplary vibratory assembly 24, four vibratory devices 40 are used as will be described in further detail below.

In particular, the vibration units 50 may incorporate conventional counter-rotating eccentric weights 54 to translate rotational movement of the eccentric weights 54 into vibratory forces along the vibratory axis A. The suppression units 52 also are or may be conventional and employ a housing 56 rigidly connected to each vibration unit 50 and a plate 58 rigidly connected to the suspension assembly 44. Resilient shock absorbing members (not shown) are connected between the housing 56 and the plate 58 such that only a portion of the vibration of the vibration unit 50 is transmitted to the plate 58 through the housing 56. Suitable vibratory devices are sold by American Piledriving Equipment as Model Number 400.

The clamp assembly 42 comprises a clamp frame 60 and a plurality of clamping devices 62. The clamping devices 62 are mounted to a lower surface of the clamp frame 60 and extend downwardly to clamp onto one of the caissons 26 and thereby secure the frame 60 relative to the caisson 26. The clamp frame 60 is large enough to extend across the diameter of the caissons 26 such that the clamping devices 62 engage predetermined angularly spaced locations about an upper perimeter edge 64 of the caisson 26.

In the exemplary vibratory assembly 24, the clamp frame 60 is generally cruciform in shape and defines eight corner locations, with one clamping device 62 located at each corner location such that the clamping devices 62 spaced at forty-five degree increments about the caisson 26. Other numbers and angular arrangements of clamping devices 62 are possible, and the exact details of the frame 60 are not critical as long as the frame 60 is capable of transmitting the vibratory forces of the vibratory devices 40 to the caisson 26.

The suspension assembly 44 comprises a plurality of suspension cables 70 attached to the crane cable 32 and a suspension frame 72 that spaces the suspension cables above the vibratory devices 40.

The timing system 46 comprises a plurality of timing shafts 80 and gear boxes 82. In the exemplary vibratory assembly 24 having four vibratory devices 40, six timing shafts 80 and three gear boxes 82 are employed. Two of the shafts 80 extend into each of the three gear boxes 82. The gear boxes 82 translate axial rotation of one of the shafts 80 extending therein into axial rotation of the other of the shafts extending therein. Each of the shafts 80 further extends into one of the vibratory devices 40, with two of the vibratory devices 40 receiving two shafts 80 and two receiving one shaft 80.

The shafts 80 and gear boxes 82 mechanically interconnect the vibratory devices 40 such that the rotation of the eccentric weights 54 within the vibratory devices 40 is synchronized in both revolution speed and phase (as determined by angular location of the eccentric weights).

In particular, the vibratory devices 40 are connected in a daisy chain manner with one of the devices 40 being the master and the other of the devices being slaves. The revolution speed and phase of the master device 40*a* is transmitted through a first shaft 80*a* to a first gear box 82*a*, from the first gear box 82*a* through a second shaft 80*b* to first slave device 40*b*, from the first slave device 40*b* through a third shaft 80*c* to a second gear box 82*b*, from the second gear box 82*b* through a fourth shaft 80*d* to a second slave device 40*c*, from the second slave device 40*c* through a fifth shaft 80*e* to a third gear box 82*c*, and from the third gear box 82*c* through a sixth shaft 80*f* to a third slave device 40*d*.

The master/slave relationship among the various vibratory devices 40*a–d* ensures that the eccentric weights 54 therein counter-rotate in synchrony such that the vibratory forces created by the vibratory devices 40*a–d* are all in phase. The in-phase vibratory forces ensure that all four quadrants of the cruciform clamp frame 60 move up and down at the same time such that the effect of the vibratory forces is cumulative and not subtractive. The cumulative driving forces of the clamping devices 40*a–d* greatly increases the ability of the system 20 to drive the caissons 26 into the ground.

I claim:

1. A system for driving a large diameter caisson into the ground, comprising:

a crane assembly;

a plurality of vibratory devices, where each vibratory device generates a vibratory force;

a clamp assembly for rigidly securing each of the vibratory devices to one of a plurality of predetermined angularly spaced locations about the caisson;

a suspension assembly for connecting the vibratory devices to the crane assembly such that transmission of vibratory forces from the vibratory devices to the crane assembly is inhibited; and a timing system operatively connecting the plurality of vibratory devices to synchronize the vibratory forces generated thereby.

2. A system as recited in claim 1, in which:

one of the vibratory devices is a master vibratory device;

another vibratory device is a slave vibratory device; and the timing system causes the slave vibratory device to generate vibratory forces based on the operation of the master vibratory device.

3. A system as recited in claim 2, in which the timing system comprises:

at least one gear box; and a plurality of shafts; where a first shaft extends from the master vibratory device to the at least one gear box; and operation of the master vibratory device causes operation of the slave vibratory device through the at least one gear box and the first and second shafts such that the vibratory forces generated by the slave vibratory device are synchronized with the vibratory forces generated by the master vibratory device.

4. A system as recited in claim 1, in which the timing system comprises:

at least one gear box; and a plurality of shafts; where each shaft extends between one of the vibratory devices and the at least one gear box; and operation of one of the vibratory devices causes operation of another of the vibratory devices through the at least one gear box and the plurality of shafts such that the vibratory forces generated by the vibratory devices are synchronized.

5. A system as recited in claim 1, in which:

one of the vibratory devices is a master vibratory device;

the other vibratory devices are slave vibratory devices; and the timing system causes the slave vibratory devices to generate vibratory forces based on the operation of the master vibratory device.

6. A system as recited in claim 5, in which the timing system comprises:

a plurality of gear boxes; and a plurality of shafts; where a first shaft extends from the master vibratory device to a first gear box;

a second shaft extends from the first gear box to a first slave vibratory device;

a third shaft extends from the first slave vibratory device to a second gear box; and a fourth shaft extends from the second gear box to a second slave vibratory device; wherein operation of the master vibratory device causes operation of the first and second slave vibratory devices through the first and second gear boxes and the first, second, third, and fourth shafts such that the vibratory forces generated by the first and second slave vibratory devices are synchronized with the vibratory forces generated by the master vibratory device.

7. A system as recited in claim 5, in which the timing system comprises:

first, second, and third gear boxes; and a plurality of shafts; where a first shaft extends from the master vibratory device to the first gear box;

a second shaft extends from the first gear box to a first slave vibratory device;

a third shaft extends from the first slave vibratory device to the second gear box;

a fourth shaft extends from the second gear box to a second slave vibratory device;

a fifth shaft extends from the second slave vibratory device to the third gear box; and a sixth shaft extends from the third gear box to a third slave vibratory device; wherein operation of the master vibratory device causes operation of the first, second, and third slave vibratory devices through the first, second, and third gear boxes and the first, second, third, fourth, fifth, and sixth shafts such that the vibratory forces generated by the first, second, and third slave vibratory devices are synchronized with the vibratory forces generated by the master vibratory device.

8. A system as recited in claim 5, in which:

each vibratory device comprises at least two eccentric weights; and the timing system comprises at least one gear box; and a plurality of shafts; wherein each shaft is operatively connected between one of the eccentric weights and the at least one gear box; and the shafts rotate based on rotation of the eccentric weights of the master vibratory device such that the eccentric weights of the slave vibratory devices rotate in synchrony with eccentric weights of the master vibratory device.

9. A system as recited in claim 1, in which the timing system interconnects the vibratory devices in a daisy chain configuration to synchronize the vibratory forces generated by the vibratory devices.

10. A system as recited in claim 1, in which:

each vibratory device comprises at least two eccentric weights; and the timing system is operatively connected between the vibratory devices such that the eccentric weights rotate at substantially the same speed.

11. A system as recited in claim 10, in which the timing system comprises:

at least one gear box; and a plurality of shafts; where each shaft is operatively connected between one of the eccentric weights and the at least one gear box; and the shafts are rotated with the eccentric weights such that the eccentric weights rotate in synchrony with each other.

12. A method of driving a large diameter caisson into the ground, comprising:

providing a plurality of vibratory devices for generating vibratory forces;

connecting the plurality of vibratory devices to a crane assembly such that transmission of vibratory forces from the vibratory devices to the crane assembly is inhibited;

rigidly securing each of the vibratory devices to one of a plurality of predetermined angularly spaced locations about the caisson;

operating each of the plurality of vibratory devices such that the vibratory devices each generate a vibratory force;

operatively connecting the plurality of vibratory devices together to synchronize the vibratory forces generated thereby.

13. A method as recited in claim 12, further comprising the steps of:

identifying one of the vibratory devices as a master vibratory device; and identifying another vibratory device as a slave vibratory device; wherein the step of operatively connecting the plurality of vibratory devices further comprises the step of operating the slave vibratory device to generate vibratory forces based on the operation of the master vibratory device.

14. A method as recited in claim 12, in which the step of operatively connecting the plurality of vibratory devices further comprises the step of interconnecting the vibratory devices in a daisy chain configuration to synchronize the vibratory forces generated by the vibratory devices.

15. A method as recited in claim 12, in which:

the step of providing the plurality of vibratory devices comprises the step of providing at least two eccentric weights; and the step of operatively connecting the plurality of vibratory devices further comprises the step of operatively connecting the vibratory devices such that the eccentric weights rotate at substantially the same speed.

16. A method as recited in claim 15, in which the step of operatively connecting the plurality of vibratory devices further comprises the steps of:

providing at least one gear box;

providing a plurality of shafts;

operatively connecting each shaft between one of the eccentric weights and the at least one gear box; and rotating the shafts with the eccentric weights such that the eccentric weights rotate in synchrony with each other.

17. A system for driving a large diameter caisson into the ground, comprising:

a crane assembly;

a plurality of vibratory devices, where each vibratory device comprises:

a housing; and eccentric weights mounted within the housing, where rotating the eccentric weights in opposite directions generate vibratory forces;

a clamp assembly for rigidly securing each of the vibratory devices to one of a plurality of predetermined angularly spaced locations about the caisson;

a suspension assembly for connecting the housings of the vibratory devices to the crane assembly such that transmission of vibratory forces from the vibratory devices to the crane assembly is inhibited; and a timing system comprising at least one gear box, and a plurality of shafts; where each shaft extends between the eccentric weights of one of the vibratory devices and the at least one gear box; and rotation of the eccentric weights of one of the vibratory devices is transmitted to rotation of the eccentric weights of another of of the vibratory devices through the at least one gear box and the plurality of shafts such that the vibratory forces generated by the vibratory devices are synchronized.

18. A system as recited in claim 17, in which: one of the vibratory devices is a master vibratory device; another vibratory device is a slave vibratory device; and the timing system causes the slave vibratory device to generate vibratory forces based on the operation of the master vibratory device.

19. A system as recited in claim 18, in which the timing system interconnects the vibratory devices in a daisy chain configuration to synchronize the vibratory forces generated by the vibratory devices.

* * * * *